US006244606B1

(12) United States Patent
Yang

(10) Patent No.: US 6,244,606 B1
(45) Date of Patent: Jun. 12, 2001

(54) FIXING SAFETY-CONTROL DEVICE FOR A COLLAPSIBLE CHILD WALKER

(76) Inventor: Peng-Yao Yang, No. 561, Section4, An Ho Rd., Tainan (TW)

( * ) Notice: Subject to any disclaimer, the term of this patent is extended or adjusted under 35 U.S.C. 154(b) by 0 days.

(21) Appl. No.: 09/386,428

(22) Filed: Aug. 31, 1999

(51) Int. Cl.[7] ..... B62B 7/10; F16M 11/24; A47C 4/48

(52) U.S. Cl. ..... 280/87.051; 280/649; 297/5; 248/407; 248/431

(58) Field of Search ..... 280/87.051, 250.1, 280/642, 649, 650; 297/5, 6; 248/431, 439, 407, 408

(56) References Cited

U.S. PATENT DOCUMENTS 4,045,045 * 8/1977 Boucher et al. ..... 280/85.051
4,433,869 * 2/1984 Payne et al. ..... 280/85.051
4,759,541 * 7/1988 Chen ..... 280/85.051
5,324,064 * 6/1994 Sumser et al. ..... 280/85.051
5,351,978 * 10/1994 Chen ..... 280/85.051
5,564,724 * 10/1996 Huang ..... 280/85.051
5,820,527 * 10/1998 Lai ..... 280/85.051

* cited by examiner

*Primary Examiner*—Lanna Mai
*Assistant Examiner*—Jeffrey J. Restifo
(74) *Attorney, Agent, or Firm*—Rosenberg, Klein & Lee

(57) ABSTRACT

A fixing safety-control device for a collapsible child walker is composed by a pressing article and an integral stopping board. On one reinforcing rib near the end of the sliding groove in the base member is provided with a crooked groove. The inserting strip provided on one end of the stopping board is inserted into the crooked groove to be fixed, and then the pressing article is penetrated through the sliding groove of the base member to let the front head be inserted into the hole of the stopping board so as to be in a fixed position. When the seat structure being collapsed, the sliding article of the connection structure will be stopped against the stopping surface of the stopping board and fixed so as to keep a safe distance from the base member to prevent a user's hands from being clamped. At last, the pressing article is pressed to let the stopping board separate from the sliding article, and by the elasticity of the hook, the child walker can be collapsed successfully and safely.

2 Claims, 4 Drawing Sheets

FIXING SAFETY-CONTROL DEVICE FOR A COLLAPSIBLE CHILD WALKER

BACKGROUND OF THE INVENTION

1. Field of the Invention

The present invention relates to a fixing safety-control device for a collapsible child walker, which is provided with a pressing article and a stopping board to fix the seat structure in a certain height, and more particularly to the fixing safety-control device with innovative features which can let the seat structure keep a safe distance from the base member so as to prevent a user's hands from being clamped when a child walker being collapsed.

2. Description of the Related Art

Referring to FIG. 1, a conventional child walker is generally composed by a base member 10, a connection structure 20 and a seat structure 30. When being collapsed, the catch board 301 of the seat structure 30 is pressed to make the catch portion 302 separate from the ratchet 303, as shown in FIGS. 2 and 3, so as to make the sliding article 201 of the connection structure 20 be forced to slide along the sliding groove 101 of the base member 10 so that the seat structure 30 will rapidly fall down to rest against the base member 10. Because of no safety-control device, when the seat structure 30 being forced to fall down, a user's hands are often clamped and hurt, as shown in FIG. 4.

SUMMARY OF THE INVENTION

Therefore, the present invention is directed to a fixing safety-control device for a collapsible child walker that substantially obviates the drawback of the related conventional art.

An object of the present invention is to provide a fixing safety-control device which can fix the sliding article of the connection structure against the stopping surface of the stopping board when the seat structure of a child walker being collapsed.

Another object of the present invention is to provide a fixing safety-control device which can fix the seat structure in a certain height to keep a safe distance from the base member so as to prevent a user's hands from being clamped when a child walker being collapsed.

Yet another object of the present invention is to provide a fixing safety-control device whose pressing article can be pressed to make the stopping board separate from the sliding article to let a child walker be collapsed safely and successfully.

Accordingly, to achieve these advantages, a fixing safety-control device for a collapsible child walker in the present invention is composed by a pressing article and an integral stopping board. On a proper section of one reinforcing rib in the bottom of the base member is provided with a crooked groove. The inserting strip provided on one end of the stopping board is inserted into the crooked groove to be fixed, and then the pressing article is penetrated through the sliding groove of the base member to let the front head be inserted into the hole of the stopping board so as to be in a fixed position. When the seat structure being collapsed, the sliding article of the connection structure will be stopped against the stopping surface of the stopping board and fixed so as to keep a safe distance from the base member to prevent a user's hands from being clamped. At last, the pressing article is pressed to let the stopping board separate from the sliding article, and by the elasticity of the hook, the child walker can be collapsed successfully and safely.

BRIEF DESCRIPTION OF THE DRAWINGS

Other features and advantages of the present invention will become apparent in the following detailed description of the preferred embodiments with reference to the accompanying drawings, in which.

DETAILED DESCRIPTION OF THE PREFERRED EMBODIMENTS

Figure 1:
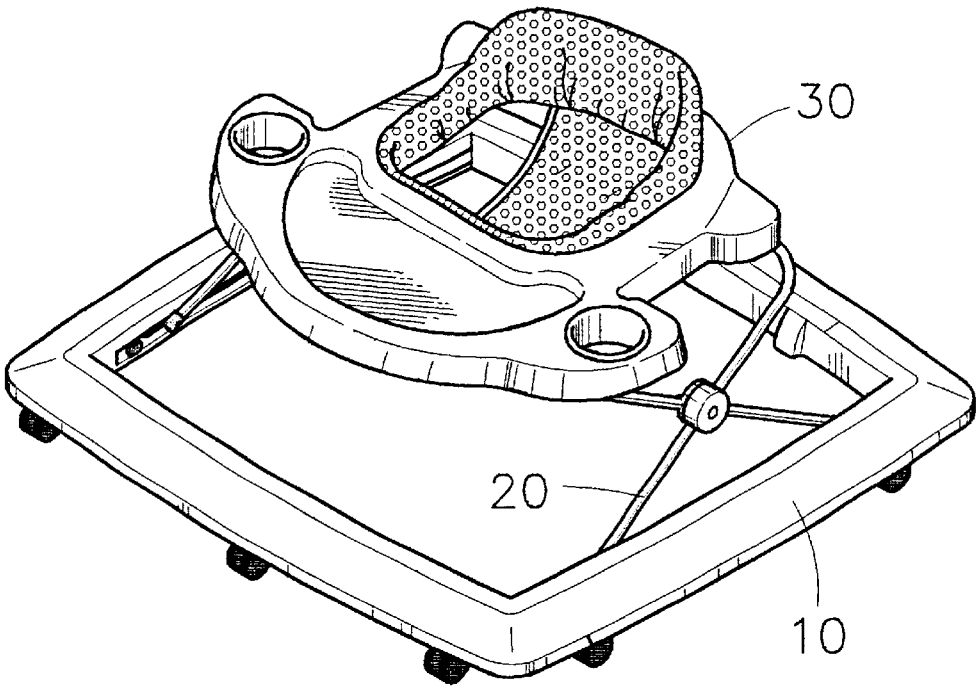
FIG.1 (PRIOR ART)
FIG. 1 is a perspective view of a conventional collapsible child walker.

A preferred embodiment of a collapsible child walker includes a base member 10, a connection structure 20, a seat structure 30 and two fixing safety-control devices 40. The fixing safety-control devices 40 in the present invention are respectively provided to control both sliding articles 201 of the connection structure 20 in the base member 10.

Figure 5:
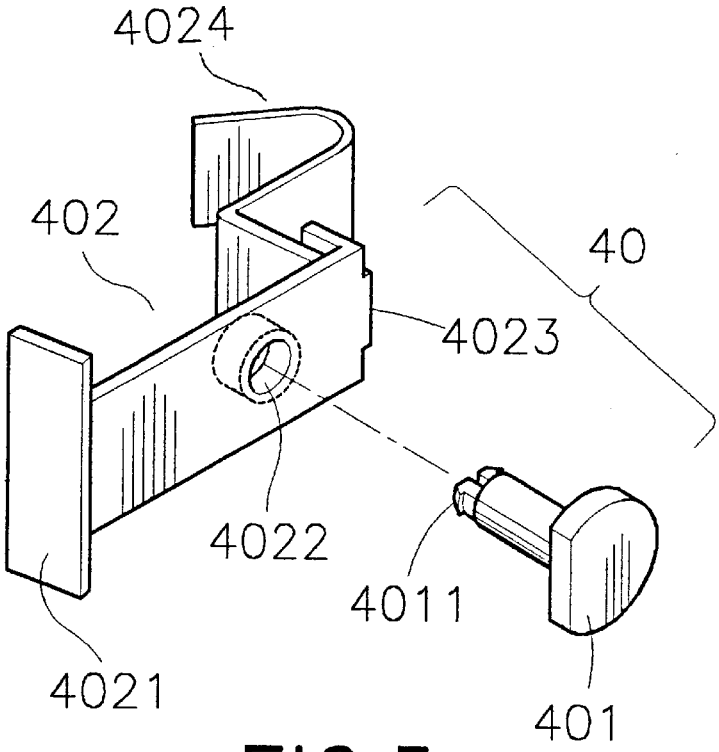
FIG. 5 is a perspective exploded view of an embodiment of a fixing safety-control device of a collapsible child walker in accordance with the present invention.

Each fixing safety-control device is composed by a pressing article 401 and an integral stopping board 402, as shown in FIG. 5. Each pressing article 401 is provided with a front head 4011 of barbs. On one end of each stopping board 402 is provided with an inserting strip 4021, a hole 4022 is provided in the central section of each stopping board 402, and the other end of each stopping board 402 is provided with a stopping surface 4023 and a hook 4024.

Figure 6:
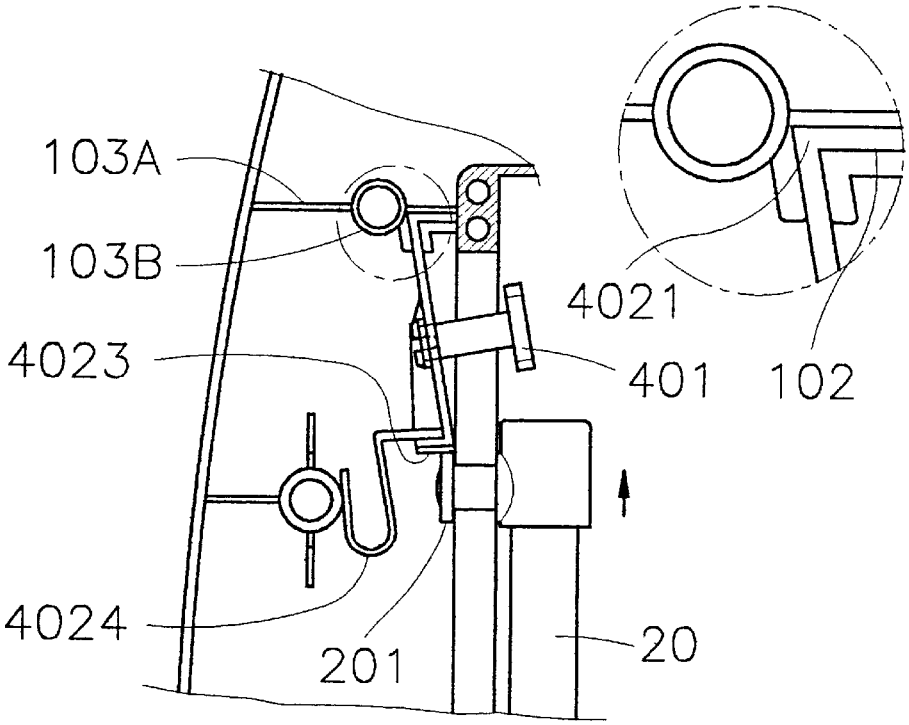
FIG. 6 is a sectional view of an embodiment of the sliding article of the connection structure being stopped to be fixed by the stopping surface of the fixing safety-control device in accordance with the present invention.

Referring to FIG. 6, on one reinforcing rib 103A near the end of each sliding groove 101 in the base member 10 is provided with a crooked groove 102 for each inserting strip 4021 provided on one end of each stopping board 402 to be inserted in and fixed. Each pressing article 401 is penetrated through each sliding groove 101 in the base member 10 to let each front head 4011 with barbs be inserted into the hole 4022 of each stopping board 402 so as to be caught and fixed.

Figure 2:
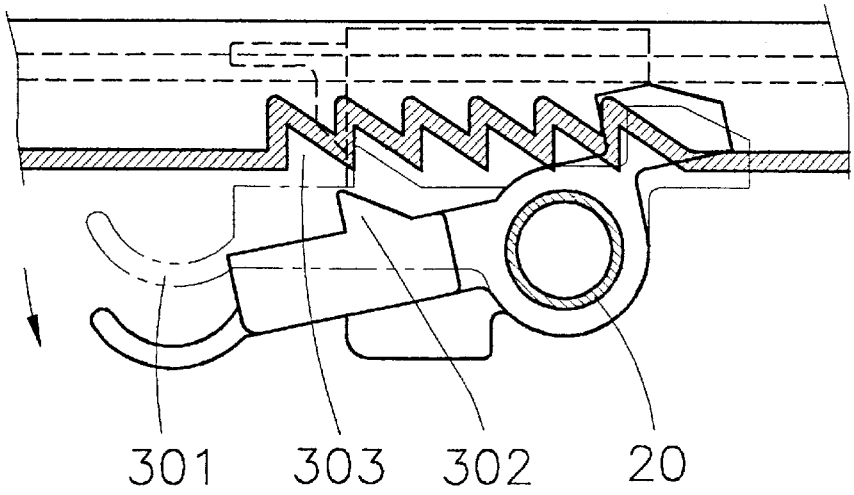
FIG.2 (PRIOR ART)
FIG. 2 is a schematic view of the catch board being pressed to make the catch portion separate from the ratchet when a conventional child walker being collapsed.
Figure 3:
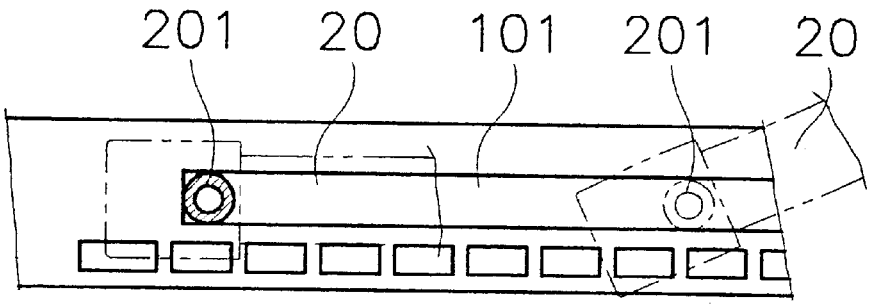
FIG.3 (PRIOR ART)
FIG. 3 is a schematic view of the sliding article of the connection structure sliding along the sliding groove of the base member when a conventional child walker being collapsed.
Figure 4:
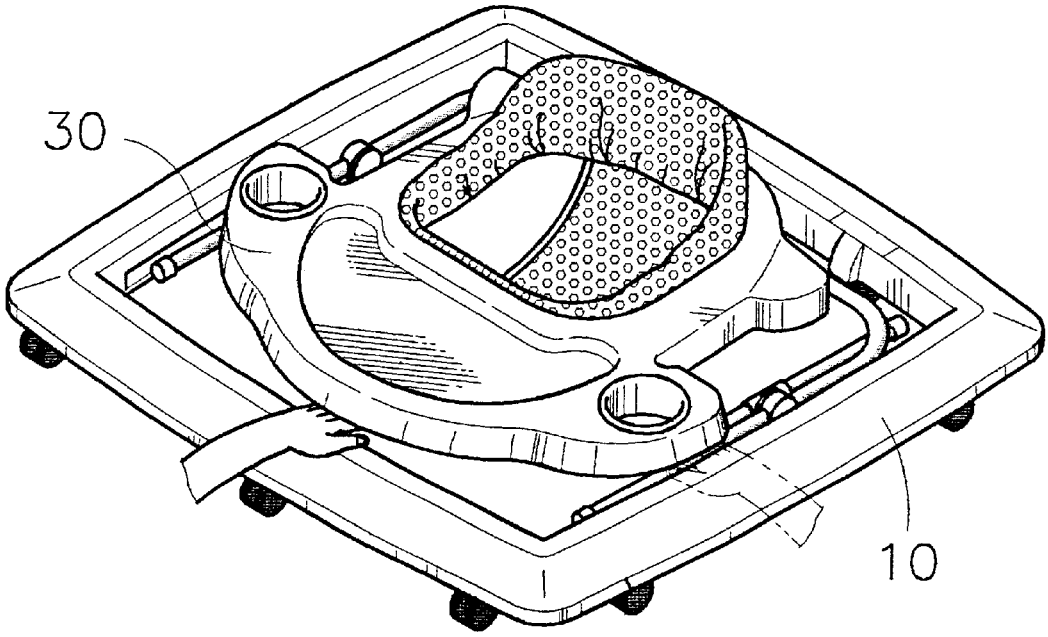
FIG.4 (PRIOR ART)
FIG. 4 is a schematic view of a user's hands being clamped by a conventional collapsed child walker.
Figure 7:
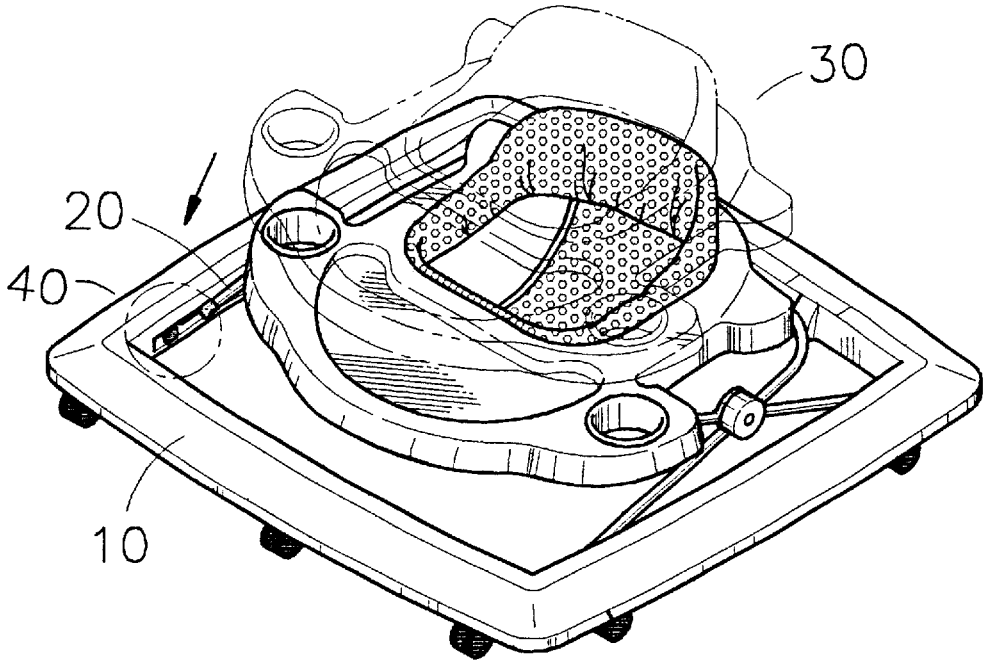
FIG. 7 is a perspective view of the seat structure being fixed by the fixing safety-control device to keep a safe distance from the base member in accordance with the present invention; and, FIG. 8 is a schematic view of the stopping board of the fixing safety-control device in accordance with the present invention being pressed to make sliding article slide successfully.
Figure 8:
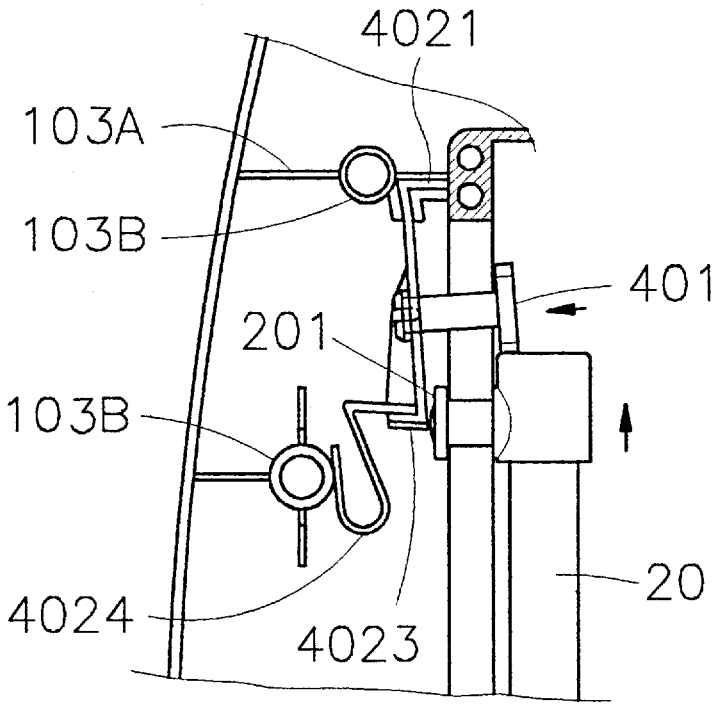

When the seat structure 30 of the child walker being collapsed, the catch board 301 of the seat structure 30 is pressed to make the catch portion 302 separate from the ratchet 303, as shown in FIG. 2. When each sliding article 201 of the connection structure 20 sliding along each sliding groove 101 in the base member 10, each sliding article 201 will be forced to stop against each stopping surface 4023 of each stopping board 402, as shown in FIG. 6. At the same time, the seat structure 30 will be kept a safe distance from the base member 10, as shown in FIG. 7, so as to prevent from clamping a user's hands. At last, each pressing article 401 is pressed to let each stopping board 402 separate from each sliding article 201, as shown in FIG. 8, and each hook 4024 provided at the other end of each stopping board 402 will properly stop against one central post 103B. By the elasticity of ache hook 4024, the child walker can be collapsed successfully and safely.

While the preferred embodiments of the invention have been described above, it will be recognized and understood that various modifications may be made therein and the appended claims are intended to cover all such modifications which may fall within the spirit and scope of the invention.

What is claimed is:

1. A combination baby walker and safety-control device, comprising:

a base member having a pair of sliding grooves formed in opposing sides thereof, said base member having a reinforcing rib adjacent an end portion of each said sliding groove and a central post, each said reinforcing rib having a crooked groove formed therein;

a collapsible seat structure coupled to said base member by a connection structure, said connection structure including a sliding article slidably disposed in each said sliding groove of said base member;

a pair of pressing articles each having a front head formed thereon, each said pressing article passing into a corresponding one of said sliding grooves; and, a pair of stopping boards each having an inserting strip formed on one end and a stopping surface and a hook on an opposing end, each said stopping board having hole formed through a central section thereof, said inserting strip being inserted and fixed within a respective one of said crooked grooves, said front head of each said pressing article being inserted and fixed in said hole of a corresponding stopping board;

wherein when said seat structure begins to be collapsed, each said sliding article is stopped against a stopping surface of a respective stopping board to maintain said seat structure a safe distance above said base member and thereby avoid clamping a user's hands, and wherein pressing each said pressing article displaces a respective stopping board to separate from a corresponding sliding article, said hook of said stopping board contacting a respective central post and provide a return bias force to said stopping board.

2. The combination baby walker and safety-control device as recited in claim 1, wherein said front head of each said pressing article is formed with barbs to engage a rrespective stopping board through said hole thereof.

* * * * *